US009000953B2

(12) United States Patent
Dauphin et al.

(10) Patent No.: US 9,000,953 B2
(45) Date of Patent: Apr. 7, 2015

(54) SOLAR NAVIGATIONAL LIGHT

(71) Applicants: Linda Dauphin, Panama City, FL (US); Kenneth Dauphin, Panama City, FL (US)

(72) Inventors: Linda Dauphin, Panama City, FL (US); Kenneth Dauphin, Panama City, FL (US)

( * ) Notice: Subject to any disclaimer, the term of this patent is extended or adjusted under 35 U.S.C. 154(b) by 31 days.

(21) Appl. No.: 13/735,097

(22) Filed: Jan. 7, 2013

(65) Prior Publication Data

US 2014/0191885 A1 Jul. 10, 2014

(51) Int. Cl.

| | |
|---|---|
| ***G08G 3/00*** | (2006.01) |
| ***B63B 45/02*** | (2006.01) |
| ***B63B 45/00*** | (2006.01) |
| ***B63B 45/04*** | (2006.01) |

(52) U.S. Cl.

CPC *G08G 3/00* (2013.01); *B63B 45/02* (2013.01); *B63B 45/00* (2013.01); *B63B 45/04* (2013.01); *B63B 2209/18* (2013.01)

(58) Field of Classification Search

CPC ..... B63B 45/00; B63B 45/02

USPC ..... 340/985; 315/133; 362/477, 545; 441/16

See application file for complete search history.

(56) References Cited

U.S. PATENT DOCUMENTS

| | | | | |
|---|---|---|---|---|
| 4,626,852 | A * | 12/1986 | Dodge | 340/985 |
| 4,763,126 | A * | 8/1988 | Jawetz | 340/985 |
| 7,378,983 | B2 * | 5/2008 | Wang et al. | 362/545 |
| 7,753,576 | B2 * | 7/2010 | Marcinkewicz et al. | 362/555 |
| 7,804,251 | B2 * | 9/2010 | Wang | 315/133 |
| 2013/0039081 | A1 * | 2/2013 | Czipri et al. | 362/477 |

* cited by examiner

*Primary Examiner* — John A Tweel, Jr.
(74) *Attorney, Agent, or Firm* — The Law Office of Jerry D. Haynes

(57) ABSTRACT

A solar powered navigational light including: a casing; at least one illuminated lenses on a front side of the casing; a battery compartment within the casing, where the battery compartment houses a rechargeable battery; and a solar panel array on a top side of the casing, where the solar panel array produces energy to charge the rechargeable battery. The solar panel array may function as a sensor to activate the illumination of the at least one illuminated lenses. In one particular embodiment, the illuminated lenses may emit a combination of red, green or white lights. The illuminated lenses may include a first lenses and a second lenses in combination.

3 Claims, 1 Drawing Sheet

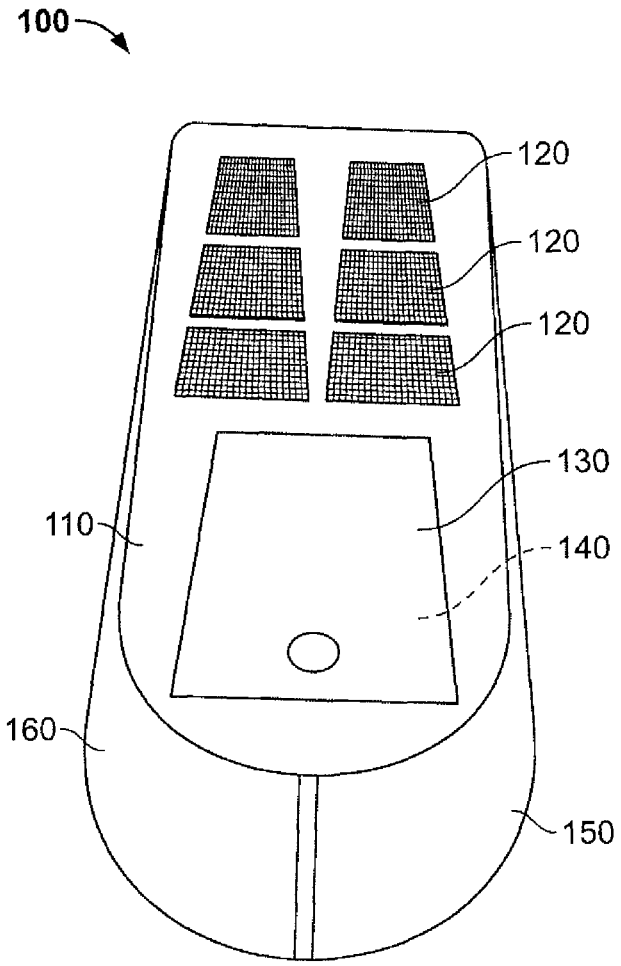
100
120
120
120
130
110
140
160
150

SOLAR NAVIGATIONAL LIGHT

BACKGROUND OF THE INVENTION

1. Field of Invention

The present invention relates to a solar powered navigational light that may be specifically used on boating vessels.

2. Description of Related Art

Navigational lights provide color illumination on waterborn vessels or aircraft and are essential in signaling the craft's position. Many times these navigational lights signal regarding the heading and status of the vessel and the lights may be used as strobe lights in certain instances so that the vessel may be identified in low light or low visibility conditions. Occasionally the marine lighting used on marine vessels helps to avoid collisions when a vessel is maneuvering over the water. Much of the lighting provided on a marine vessel is required per international regulations. Many times this lighting is displayed or illuminated in various colors such as red, green or white in order to identify the type of marine vessel and gives other vessels an opportunity to determine the angle and direction of the vessel in order to avoid collision. Consequently it's imperative that these navigational lights are energized and functional at all times while the vessel is under operation. Many navigational lights are battery operated, which inherently requires monitoring and replacing batteries. Consequently it would be advantageous to have other sources of energy to power the lights.

SUMMARY OF THE INVENTION

The present invention relates to a solar powered navigational light comprising: a casing; at least one illuminated lenses on a front side of the casing; a battery compartment within the casing, where the battery compartment houses a rechargeable battery; and a solar panel array on a top side of the casing, where the solar panel array produces energy to charge the rechargeable battery. The solar panel array may function as a sensor to active the illumination of the at least one illuminated lenses. In one particular embodiment, the illuminated lenses may emit a combination of red, green or white lights. The illuminated lenses may include a first lenses and a second lenses in combination.

BRIEF DESCRIPTION OF DRAWINGS

FIG. 1 depicts a perspective view of a solar powered navigational light in accordance with the present invention.

DETAILED DESCRIPTION

The present invention relates to a solar powered navigational light utilized to illuminate colored lights on a marine vessel. The navigational light according to the present invention uses solar panels and a battery-powered light for illumination. The present invention utilizes a rechargeable battery that receives its power from the solar panels placed directly on the housing of the navigational light.

In reference to FIG. 1, a depiction of a solar powered navigational light 100 is provided. The solar navigational light 100 includes a series of solar panels 120 along a top side 110 of a light casing. This top side 110 is positioned so that it is exposed to ultraviolet rays and in accordance generates energy through the use of the solar panel array provided. The solar panel array 120 extends over a length of the top surface 110 and consequently provides a very receptive area for the receiving of ultraviolet rays. A battery compartment 130 is also provided along the top surface 110. This battery compartment 130 houses a battery 140, not shown, that provides power to illuminate the lighting provided on the front side of the navigational light 100.

Lenses 150, 160 are provided along the front side of the navigational light 100. These lenses 150, 160 may be shaded to provide appropriate colors for vessel navigation. Typical colors used in marine vessel navigation primarily include red, green and white. In one particular embodiment of the present invention, the lens 160 may illuminate a red light and lens 150 may illuminate a green light. Further the lenses may both illuminate a single color light or a different combination of colored light, i.e., red, white or even green and white.

The advantage of using the solar powered navigational light according to the present invention is the elimination of other common power sources used for vessel light illumination. Many times marine vessels use wired switches and external batteries that can wear out or malfunction over time. The present invention utilizes an enclosed casing 110 that may be manufactured of plastic or stainless steel material. The seal of the battery compartment 130 is waterproof and further the solar panels are also waterproof. Advantageously the battery provided may be charged via the solar panels at 120.

The lenses provided on the navigational light may include light emitted diode lighting (LED) within the casing. The casing 110 is a completely self-contained and automatically operates via control systems that are provided within the casing itself. The user may manipulate these controls as needed to control buttons and switches on the underside of the casing not shown. Consequently the solar panels may also serve as a sensor to activate the on and off function related to the present invention. The lights may therefore illuminate upon sundown and therefore automatically provide navigational lighting automatically. The instant invention has been shown and described in what it considers to be the most practical and preferred embodiments. It is recognized, however, that departures may be made there from within the scope of the invention and that obvious modifications will occur to a person skilled in the art.

What is claimed is:

1. A solar powered navigational light comprising:

a. a casing;

b. a first illuminated lens on a front side of the casing;

c. a second illuminated lens on a front side of the casing, where the second illuminated lens is adjacent and abuts the first illuminated lens;

d. a battery compartment within the casing, where the battery compartment houses a rechargeable battery; and e. a solar panel array on a horizontal top side of the casing, where the solar panel array is arranged in two rows and produces energy to charge the rechargeable battery.

2. The solar powered navigational light according to claim 1, where the solar panel array functions as a sensor to activate the illumination of the first illuminated lens and the second illuminated lens.

3. The solar powered navigational light according to claim 1, where the first illuminated lens and the second illuminated lens emits a combination of a red, green or white lights.

* * * * *